US008747026B2

(12) United States Patent
Quah et al.

(10) Patent No.: US 8,747,026 B2
(45) Date of Patent: Jun. 10, 2014

(54) INSTALLATION VESSEL

(75) Inventors: Chin Kau Quah, Singapore (SG); Kok Seng Foo, Singapore (SG); Cheng Choong Chan, Singapore (SG)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 60 days.

(21) Appl. No.: 13/222,823

(22) Filed: Aug. 31, 2011

(65) Prior Publication Data

US 2012/0055389 A1 Mar. 8, 2012

(30) Foreign Application Priority Data

Sep. 1, 2010 (SG) ..... 201006451

(51) Int. Cl.
*E02B 17/08* (2006.01)
*B63B 35/44* (2006.01)

(52) U.S. Cl.
USPC ..... 405/198; 405/196

(58) Field of Classification Search
CPC ..... E02B 17/06; E02B 17/0818; E02B 17/08; E02B 17/0872; B63B 9/065
USPC ..... 405/196, 198, 199, 203
See application file for complete search history.

(56) References Cited

U.S. PATENT DOCUMENTS

| | | | | | |
|---|---|---|---|---|---|
| 4,589,799 | A * | 5/1986 | Hotta et al. | ..... | 405/196 |
| 5,906,457 | A * | 5/1999 | Choate et al. | ..... | 405/198 |
| 5,915,882 | A * | 6/1999 | Darwiche et al. | ..... | 405/198 |
| 6,076,996 | A * | 6/2000 | Choate et al. | ..... | 405/198 |
| 6,231,269 | B1 * | 5/2001 | Shear et al. | ..... | 405/198 |
| 7,726,910 | B2 * | 6/2010 | Foo et al. | ..... | 405/198 |
| 2002/0182014 | A1 * | 12/2002 | Kawasaki | ..... | 405/196 |
| 2005/0260040 | A1 * | 11/2005 | Ingle et al. | ..... | 405/198 |
| 2006/0056920 | A1 * | 3/2006 | Foo et al. | ..... | 405/196 |
| 2006/0062637 | A1 * | 3/2006 | Foo et al. | ..... | 405/198 |
| 2008/0131209 | A1 * | 6/2008 | Thomas | ..... | 405/198 |
| 2008/0226397 | A1 * | 9/2008 | Foo et al. | ..... | 405/198 |
| 2010/0067989 | A1 * | 3/2010 | Brown et al. | ..... | 405/196 |

* cited by examiner

*Primary Examiner* — Benjamin Fiorello
(74) *Attorney, Agent, or Firm* — Cantor Colburn LLP

(57) ABSTRACT

An installation vessel for installing an offshore structure, the installation vessel comprising a hull and a plurality of legs, each leg comprising vertical chords and cross braces, the hull having a plurality of leg openings each configured for passage of a leg therethrough, each leg opening having a number of jack-cases for supporting pinions thereon, each pinion being configured for rotatably engaging a rack disposed on a chord of the leg to move the leg relative to the hull, each jack-case comprising a number of guides for guiding passage of the leg through the leg opening, each guide comprising a plurality of angled surfaces configured for sliding engagement with a corresponding plurality of surfaces of a rack, each of the plurality of angled surfaces comprising a wear plate.

5 Claims, 5 Drawing Sheets

INSTALLATION VESSEL

TECHNICAL FIELD

This invention relates generally to vessels for installing offshore structures and relates more particularly, though not exclusively, to a vessel for installing offshore wind turbines.

BACKGROUND

A jack-up rig is an offshore oil exploration drilling structure for use in shallow water, typically in water depths up to 500 feet. The jack-up rig normally comprises a floatable hull with a deck or working platform and three or four legs. The legs pass through leg openings in the hull and are moveable relative to the hull. After the jack-up rig has arrived on location, the legs of the jack-up rig are lowered until they touch a seabed beneath the hull. This allows the hull to be supported by the legs that rest on a foundation soil on the seabed so that the hull may be jacked up using a jacking system to raise the working platform above the water, making the jack-up rig safer to be operated in open water situations where water movement is experienced.

The legs of a jack-up rig are commonly trusses, each truss comprising a number of vertical chords interconnected with cross braces. A leg typically comprises three or four chords. The legs normally terminate in a footing that rests on the seabed. The footing provides an enlarged soil bearing area so as to reduce pressure exerted on the soil of the seabed. This in turn reduces bearing capacity that is required by the soil to support the jack-up rig, allowing the jack-up rig to be operated in a greater variety of locations and soil types.

To move the legs relative to the hull, a rack-and-pinion mechanism is normally used. Each vertical chord of each leg is typically provided with two longitudinally aligned racks disposed diametrically on either side of the chord, with the teeth of each rack directed laterally away from the chord. Pinions to engage the racks are provided on jack-cases that are installed in the leg openings in the hull through which the legs pass. Rotation of the pinions on the jack-cases against the racks on the chords of each leg thus moves the leg relative to the hull. To keep the legs aligned as they pass through the leg openings in the hull, guides are provided in the jack-cases for sliding engagement with the racks on the chords of the legs as the legs are moved relative to the hull.

For offshore oil exploration, the jack-up rig is normally brought to site and installed there for months at a stretch. This means that relative movement of the legs occurs only every few months at most, that is, when the jack-up rig arrives at site and is installed, and when the exploration operation is completed months afterwards and the jack-up rig leaves the site.

For installing structures such as offshore wind turbines, a jack-up barge that operates similarly to jack-up rigs is often used. Installing one wind turbine from an installation vessel such as a jack-up barge typically takes only a few days. An offshore wind farm can comprise scores to several hundred individual wind turbines. Installing an entire offshore wind farm therefore requires the installation vessel to be moved from one designated wind turbine site to the next designated wind turbine site every few days, several hundred times over.

Moving a jack-up barge every few days several hundred times means that legs of the jack-up barge have to be raised and lowered relative to the hull at least an equal number of times. Guides currently used in oil exploration jack-up rigs are therefore not suitable for use in installation vessels such as jack-up barges because they are designed only to slideably engage the racks on the legs at most a few times every few months, and are consequently unable to withstand the wear from sliding against the racks every few days many times over, as would be required when installing offshore wind turbines.

SUMMARY

An installation vessel comprising a jack-up barge is provided. The jack-case at each leg leg opening in the hull is provided with guides for sliding engagement with racks attached to chords of the leg. Each guide is provided with removable wear plates that slide against the racks. The removable wear plates may be releasably attached to fixed claws in the jack-case, or to removable claws in the jack-case. Where the wear plates are attached to removable claws, replacing the wear plates entails removing the removable claw with the wear plates attached thereto, changing replacing the wear plates on the removable claw, and replacing the removable claw with new wear plates in the jack-case. In this way, to accommodate rapid wear of the wear plates due to frequent movement of the legs relative to the hull when installing wind turbines of a wind farm, the wear plates may be readily removed and replaced, allowing prolonged use of the installation vessel together with high frequency of movement of the legs.

According to a first exemplary aspect, there is provided an installation vessel for installing an offshore structure, the installation vessel comprising a hull and a plurality of legs, each leg comprising vertical chords and cross braces, the hull having a plurality of leg openings each configured for passage of a leg therethrough, each leg opening having a number of jack-cases for supporting pinions thereon, each pinion being configured for rotatably engaging a rack disposed on a chord of the leg to move the leg relative to the hull, each jack-case comprising a number of guides for guiding passage of the leg through the leg opening, each guide comprising a plurality of angled surfaces configured for sliding engagement with a corresponding plurality of surfaces of a rack, each of the plurality of angled surfaces comprising a wear plate.

Each wear plate may be configured to be readily removable from the jack-case and readily replaceable.

Each guide may comprise a removable claw configured for releasable attachment of the wear plates thereto, the plurality of angled surfaces being provided on the removable claw.

Each guide may further comprise a fixed claw configured for releasable attachment of the removable claw thereto.

The wear plates may be configured to be relatively angled for sliding engagement with a corresponding plurality of surfaces of a rack.

The plurality of surfaces of the rack may comprise tips of teeth of the rack, a front surface of the teeth of the rack and a rear surface of the teeth of the rack.

The jack-case may comprise a maintenance cavity for allowing human access to a guide disposed in a portion of the jack-case located within the hull.

According to a second exemplary aspect, there is provided a wear plate configured to be readily removable from a jack-case of a leg opening in a hull of an installation vessel as described above.

BRIEF DESCRIPTION OF THE DRAWINGS

In order that the invention may be fully understood and readily put into practical effect there shall now be described by way of non-limitative example only exemplary embodiments, the description being with reference to the accompanying illustrative drawings.

In the drawings.

DETAILED DESCRIPTION OF EXEMPLARY EMBODIMENTS

An installation vessel 10 will be described with reference to FIGS. 1 to 12.

Figure 1:
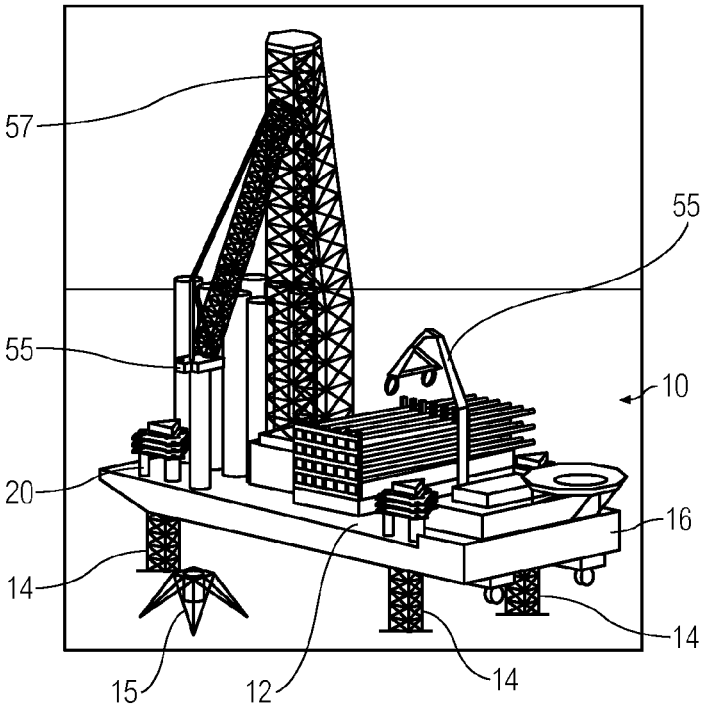
FIG. 1 is a perspective view of an exemplary installation vessel.
Figure 2:
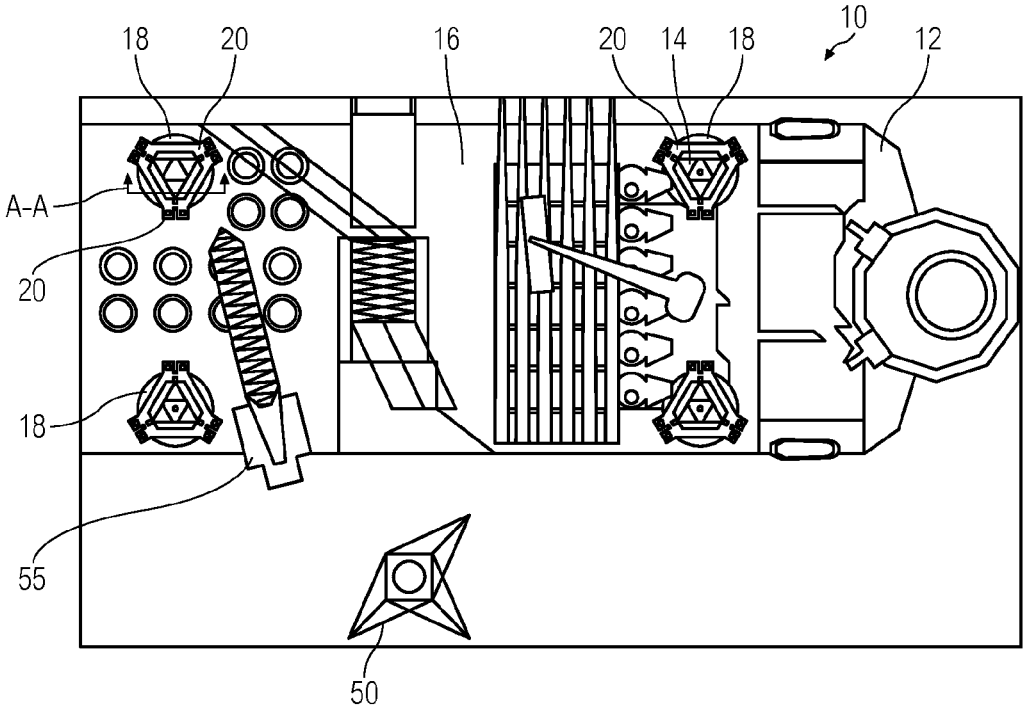
FIG. 2 is a top view of an exemplary installation vessel.

As shown in FIGS. 1 and 2, the installation vessel 10 comprises a plurality of legs 14 and a hull 16. The legs 14 pass through leg openings 18 in the hull 16. Each leg opening 18 comprises a number of jack-cases 20 corresponding to a number of chords 21 in each leg 14.

Figure 3:
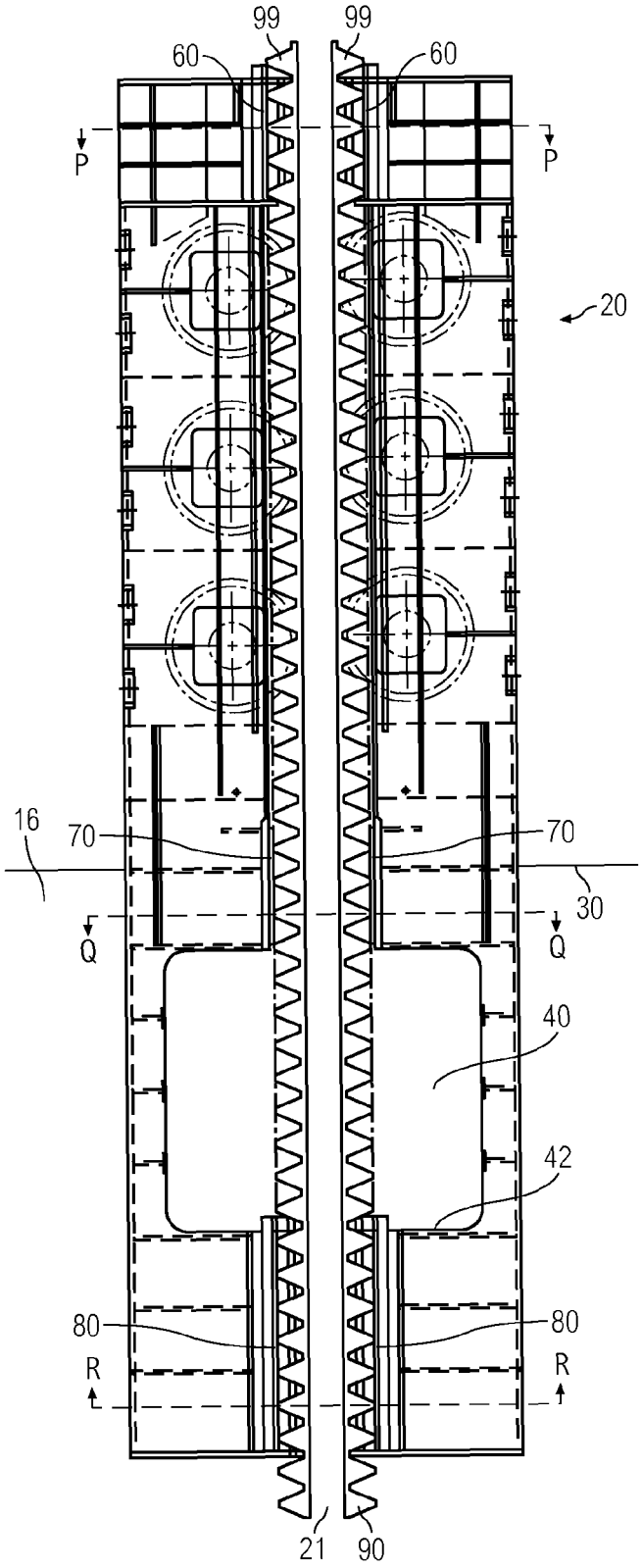
FIG. 3 is a side-sectional view of a jack-case of the vessel of FIG. 2 at section A-A.

Guides 60, 70, 80 are provided in each jack-case 20 for guiding passage of the leg 14 through the leg opening 18, as shown in FIG. 3. The guides 60, 70, 80 are preferably disposed at different heights on each jack-case 20 to counter bending moment of the leg 14 within the jack-case 20. At each height, the guides 60, 70, 80 are preferably provided in pairs so that each pair of guides 60, 70, 80 engages the two racks 99 disposed diametrically on each chord 21 of the leg 14.

Figure 4:
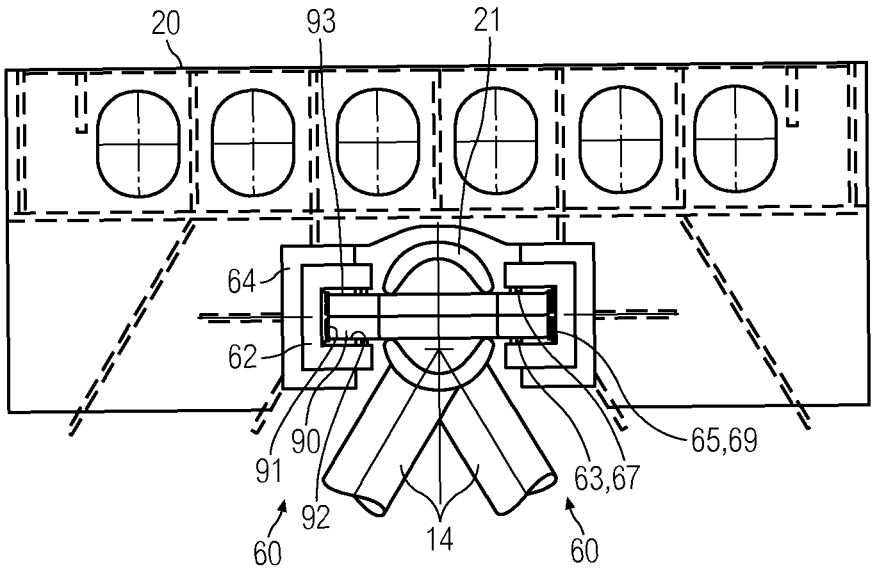
FIG. 4 is a top sectional view of a first exemplary guide of the jack-case of FIG. 3 at section P-P.

A first exemplary guide 60 comprises a removable claw 62 having a plurality of angled guide surfaces 63, 65, such as that provided in a C-shaped channel as shown in FIG. 4 where the angle between adjacent guide surfaces 63, 65 is 90°. The guide 60 also comprises a fixed claw 64 being correspondingly angled or C-shaped for releasable attachment of the removable claw 62 thereto. Wear plates 67, 69 are attached to the plurality of surfaces 63, 65 to engage a corresponding plurality of surfaces of a rack 99. For example, the wear plates 67, 69 may slide against tips 91 of the teeth 90 of a rack 99, a front surface 92 of the teeth 90 of the rack 99 as well as a rear surface 93 of the teeth of the rack 99. Because more sliding surfaces 67, 69 are provided by the C-shaped channel of the guide 60, wear of each surface 67, 69 is relatively reduced since the load from the teeth 90 of the rack 99 are distributed over a larger total surface area, as compared with only a single guide surface contacting the tips 91 of the teeth 90. In this way, each surface 67, 69 can have a longer operating life.

The wear plates 67, 69 are configured to be readily removable from the jack-case 20 and to be readily replaceable. This is desirable because the wear plates 67, 69 are quickly worn down with frequent movement of the legs 14 relative to the hull 16 during installation of offshore structures such as a wind farm comprising hundreds of wind turbines. By allowing the wear plates 67, 69 to be readily removable and replaceable, the installation vessel 10 can continue to operate at optimal levels by simply replacing the wear plates 67, 69 whenever they are too worn. In this way, little down-time is required unlike conventional jack-up rigs where significant down-time is needed to change conventional jack-case guides with built in wear plates that cannot be removed.

Figure 5:
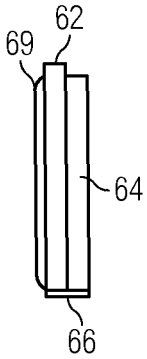
FIG. 5 is a side sectional view of the guide of FIG. 4.
Figure 6:
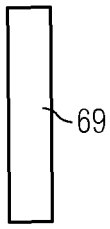
FIG. 6 is a side elevation view of a wear plate of the guide of FIG. 5.

By providing the removable claw 62, removable of the wear plates 67, 69 from the jack-case can be as simple as sliding the removable claw 62 together with the attached wear plates 67, 69 out of the C-shaped channel of the fixed claw 64. A stopper 66 shown in FIG. 5 is provided at a lower end of the guide 60. The stopper 66 locates the removable claw 62 longitudinally within the jack-case, allowing easy replacement of the removable claw 62 after the wear plates 67, 69 have been changed.

Figure 7:
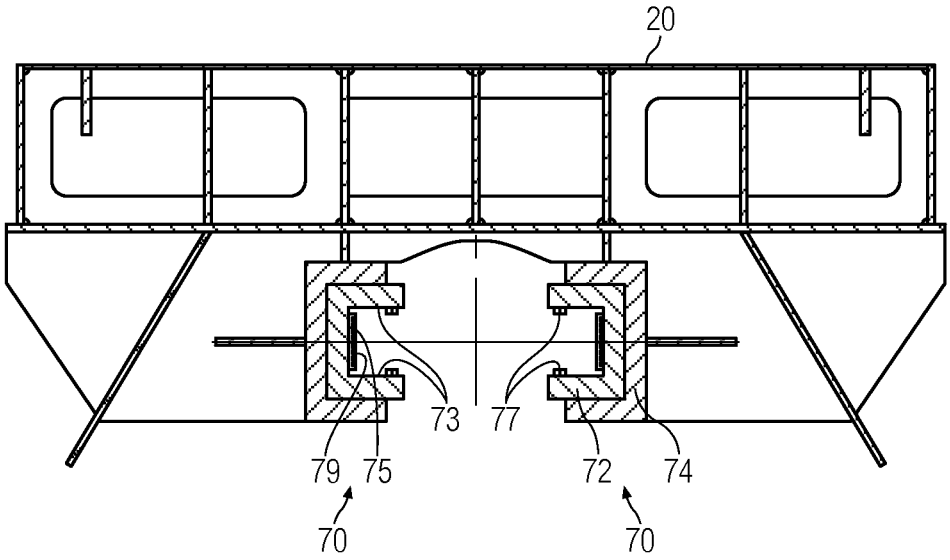
FIG. 7 is a top sectional view of a second exemplary guide of the jack-case of FIG. 3 at section Q-Q.
Figure 8:
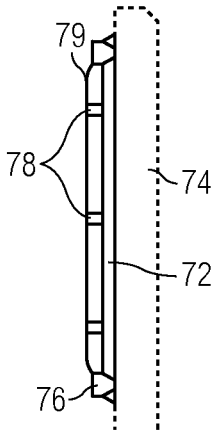
FIG. 8 is a side sectional view of the guide of FIG. 7.
Figure 9:
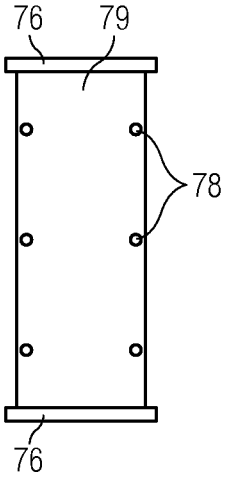
FIG. 9 is a side elevation view of a wear plate of the guide of FIG. 8.

A second exemplary guide 70 shown in FIGS. 7 to 9 comprises removable wear plates 77, 79 that are releasably attachable to an inner C-shaped claw 72 have a plurality of angled guide surfaces 73, 75. The inner claw 72 rests in an outer C-shaped claw 74. In the second exemplary guide 70, the wear plates may be releasably attached to the inner claw 72 by securing means such as screws (not shown) passed through holes 78 provided in the wear plates 77, 79. Stoppers 76 may be provided on the inner claw 72 for easily locating the wear plates 77, 79 in the guide 70 for easy replacement when the wear plates 77, 79 are changed.

Figure 10:
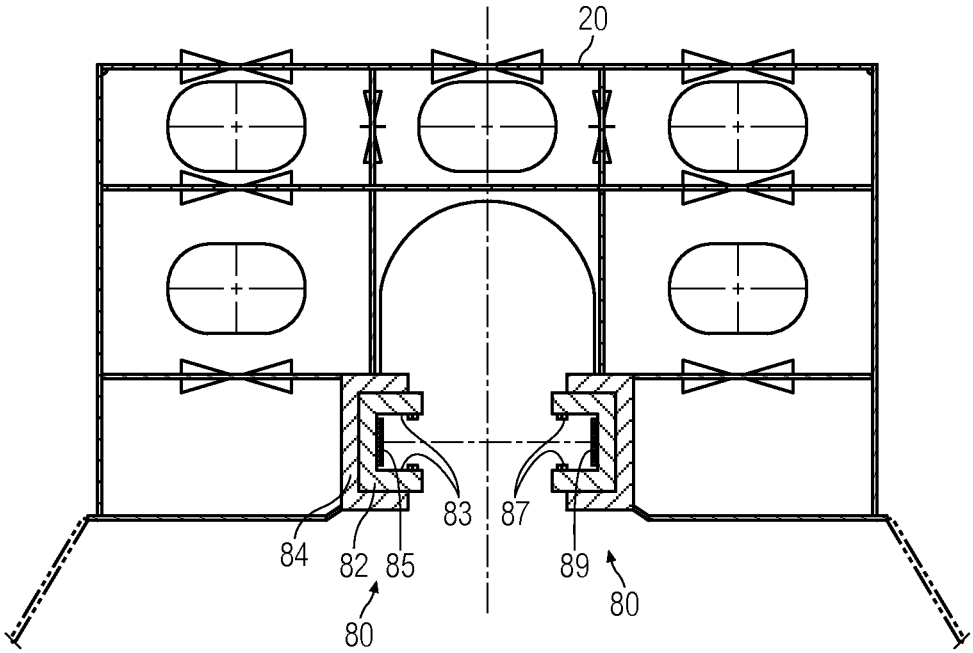
FIG. 10 is a top sectional view of a third exemplary guide of the jack-case of FIG. 3 at section R-R.
Figure 11:
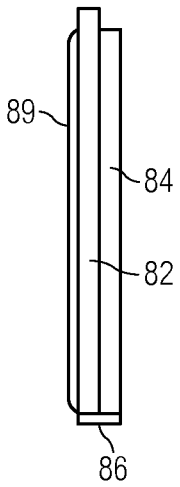
FIG. 11 is a side sectional view of the guide of FIG. 10.
Figure 12:
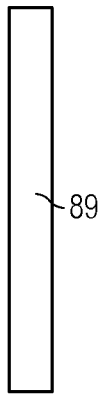
FIG. 12 is a side elevation view of a wear plate of the guide of FIG. 11.

A third exemplary guide 80 is shown in FIGS. 10 to 12. The third exemplary guide 80 is similar to the first exemplary guide 60 in having a removable claw 82 comprising angled guide surfaces 83, 85 provided by a C-shaped channel as shown in FIG. 10 and a fixed claw 84 having a corresponding C-shape for releasable attachment of the removable claw 82 thereto. Removable wear plates 87, 89 are releasably attachable to the removable claw 82. A stopper 86 is provided for locating the removable claw 82 relative to the fixed claw 84 when replacing the wear plates 87, 89 by removing the removable claw 82 from the fixed claw 84. The third exemplary guide 80 is preferably about 1.5 to 2.5 times longer than the first exemplary guide 60 due to their relative positions in the jack-case. Because the third exemplary guide 80 is located lower on the jack-case than the first exemplary guide 60, greater loads from the leg 14 are experienced by the third exemplary guide 80. Accordingly, a greater contact surface is preferably provided by making the third exemplary guide 80 longer so as to withstand the greater loads and to better keep the leg 14 aligned against bending moments.

To allow access to a guide 70, 80 that is disposed in a portion of the jack-case 20 located within the hull 16, a maintenance cavity 40 with a working platform 42 may be provided in the jack-case 20 in order to carry out replacement of the removable wear plates 77, 79, 87, 89.

Besides the larger surface areas 67, 69 provided for wear against the teeth 91 of the racks 99, a tighter tolerance is also achieved by configuring the guides 60, 70, 80 to have angled surfaces 63, 65, 73, 75, 83, 85 provided by the C-shaped channels. The tighter tolerance allows for each leg 14 to be installed with superior straightness through each leg opening 18, thereby reducing bending moments induced in the legs 14.

Whilst there has been described in the foregoing description exemplary embodiments of the present invention, it will be understood by those skilled in the technology concerned that many variations in details of design, construction and/or operation may be made without departing from the present invention. For example, for installing a wind turbine onto a pre-installed foundation such as a jacket 50 on a seabed, the installation vessel 10 may be further provided with one or more cranes 55 and or a mast 57 for manipulating and assembling various components of the wind turbine onto the foundation 50.

The invention claimed is:

1. An installation vessel for installing an offshore structure, the installation vessel comprising a hull and a plurality of legs, each leg comprising vertical chords and cross braces, the hull having a plurality of leg openings each configured for passage of a leg therethrough, each leg opening having a number of jack-cases for supporting pinions thereon, each pinion being configured for rotatably engaging a rack disposed on a chord of the leg to move the leg relative to the hull, each jack-case comprising a number of guides for guiding passage of the leg through the leg opening, each guide comprising a plurality of angled surfaces configured for sliding engagement with a corresponding plurality of surfaces of a rack, each of the plurality of angled surfaces comprising a wear plate, wherein each wear plate is adapted to be readily removable from the jack-case and readily replaceable, and wherein each guide further includes a removable claw configured for releasable attachment of the wear plates thereto, the plurality of angled surfaces being provided on the removable claw.

2. The installation vessel of claim 1, wherein each guide further comprises a fixed claw configured for releasable attachment of the removable claw thereto.

3. The installation vessel of any preceding claim, wherein the plurality of surfaces of the rack comprises tips of teeth of the rack, a front surface of the teeth of the rack and a rear surface of the teeth of the rack.

4. The installation vessel of claim 1, wherein the jack-case comprises a maintenance cavity for allowing human access to a guide disposed in a portion of the jack-case located within the hull.

5. A wear plate for use in an installation vessel for installing an offshore structure, the installation vessel comprising: a hull and a plurality of legs, each leg including vertical chords and cross braces, the hull having a plurality of leg openings each configured for passage of a leg therethrough, each leg opening having a number of jack-cases for supporting pinions thereon, each pinion being configured for rotatably engaging a rack disposed on a chord of the leg to move the leg relative to the hull, each jack-case including a number of guides for guiding passage of the leg through the leg opening, each guide having a plurality of angled surfaces configured for sliding engagement with a corresponding plurality of surfaces of a rack, each of the plurality of angled surfaces including said wear plate, wherein said wear plate is adapted to be readily removable from a jack-case of a leg opening in a hull of the said installation vessel, wherein each guide further includes a removable claw configured for releasable attachment of the wear plates thereto, the plurality of angled surfaces being provided on the removable claw.

* * * * *